United States Patent [19]

Gropper et al.

[11] 4,305,546

[45] Dec. 15, 1981

[54] LARGE DIAMETER AIR DRIVEN CENTRIFUGE ROTOR

[75] Inventors: Lee Gropper, Los Altos Hill; Armen L. Leonian, Woodside, both of Calif.

[73] Assignee: Beckman Instruments, Inc., Fullerton, Calif.

[21] Appl. No.: 164,879

[22] Filed: Jul. 1, 1980

[51] Int. Cl.[3] ..... B04B 9/06

[52] U.S. Cl. ..... 233/24; 233/26

[58] Field of Search ..... 233/26, 24, 23 R, 23 A, 233/27, 1 R, 1 C, 17; 366/250

[56] References Cited

U.S. PATENT DOCUMENTS

| | | | |
|---|---|---|---|
| 2,733,857 | 2/1956 | Beams | 233/24 |
| 3,456,875 | 7/1969 | Hein | 233/24 |
| 3,825,178 | 7/1974 | Burg | 233/26 |
| 3,923,241 | 12/1975 | Cyphelly | 233/24 |

FOREIGN PATENT DOCUMENTS

| | | | |
|---|---|---|---|
| 839622 | 6/1960 | United Kingdom | 233/23 R |

*Primary Examiner*—Robert W. Jenkins

*Attorney, Agent, or Firm*—R. J. Steinmeyer; F. L. Mehlhoff; William H. May

[57] ABSTRACT

A large diameter air driven centrifuge rotor which holds a plurality of centrifuge tubes in a fixed horizontal position. The rotor is designed to operate in a stable and smooth condition on a rotor seat which is smaller than the diameter of the rotor. Although the rotor essentially covers the rotor seat portion of the centrifuge, the rotor is designed in such a manner that the air flow from the driving air being exerted on the rotor will properly exit from between the rotor and the seat without affecting a stable smooth operation of the rotor.

7 Claims, 6 Drawing Figures

LARGE DIAMETER AIR DRIVEN CENTRIFUGE ROTOR

BACKGROUND OF THE INVENTION

The present invention is directed to the field of centrifugation and, more particularly, is directed to air driven centrifuge rotors designed to hold the centrifuge tubes in a horizontal position for centrifugation.

The existing rotors used in air driven centrifuges are relatively small and do not provide for the orientation of the centrifuge tube in the horizontal position during centrifugation. The tubes in the presently existing air driven centrifuges have the tubes oriented at some acute angle with respect to the spin axis of the rotor. However, in order to provide a more desirable centrifugation path for separation of the constituents of a fluid sample during centrifugation, it is necessary to have the longitudinal axis of the tube be oriented perpendicular to the spin axis of the rotor during centrifugation.

Because air driven centrifuge rotors are relatively small, being one and one half (1.5) inches in diameter, and because the air drive centrifuges are small, limitations exist with respect to how large in size an air driven centrifuge rotor can be and still operate properly in a centrifuge having limited space. Although it would be extremely desirable to have an air driven centrifuge rotor with horizontally oriented tubes during centrifugation, the space requirements in an air driven centrifuge have prevented utilization of such a rotor. Typically, if the rotor is larger than the rotor seat area, the flow of the air exiting between the rotor and the rotor seat will be constrained or restricted to the extent that the operation of the rotor would be unstable. Consequently, it has been felt that the only way possible to provide an air driven rotor of significant size to permit the horizontal orientation of the tubes would be to build a completely new centrifuge having a large enough rotor seat to accommodate the larger rotor.

However, one goal of centrifuge designs is to use the same centrifuge machine to accommodate a variety of functions by the use of interchangeable rotors. In the air drive centrifuge a desire exists to have a swinging tube rotor, but the centrifuge size and the small tubes have made such a design impractical.

SUMMARY OF THE INVENTION

The air driven centrifuge rotor of the present invention is designed to be compatible with existing air driven centrifuges having a specified rotor seat size. This air driven centrifuge rotor has a base portion which is large enough to accommodate a plurality of centrifuge tubes in a fixed horizontal orientation. Although the main portion of the rotor which is designed to hold the tubes in the horizontal orientation is larger than the rotor seat of the centrifuge and covers the rotor seat as well as the stator pad, the air flow exiting from between the rotor and the rotor seat is accommodated in such a manner that the operation of the rotor will be stable during centrifugation.

In order to properly accommodate for the volume of exiting driving air from between the rotor and the rotor seat, the rotor has a large air relief path between the rotor and the seat even though the rotor base or bottom protrudes over or covers the rotor seat area.

Although the rotor is somewhat larger than presently used rotors orienting the tubes at an acute angle to the spin axis of the rotor, the present rotor is designed to utilize the same size 4.8 by 19.9 millimeter tubes positioned in a horizontal orientation without the use of separate capping means for each individual tube. Surface tension surprisingly retains the fluid sample within the tube even when the tube is nearly filled with the fluid sample. When the rotor top or cover is placed over the tubes and on the rotor, the exterior of the tubes in their horizontal position are completely supported by the recesses within the rotor base in conjunction with the top which is securely fastened to the rotor base.

Consequently, by the use of the rotor of the present invention an operator can place a plurality of centrifuge tubes in a horizontal orientation in an air driven centrifuge rotor and obtain much more desirable centrifuge results utilizing the same air driven centrifuge that is used to drive the presently existing rotors having the tubes oriented at an acute angle to the spin axis of the rotor.

DETAILED DESCRIPTION OF THE INVENTION

Figure 3:
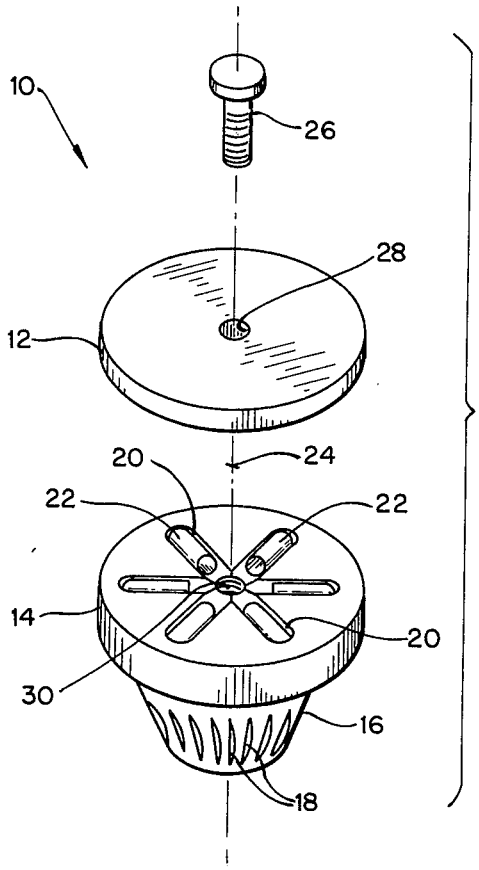
FIG. 3 is a perspective view of the air driven centrifuge rotor of the present invention showing the interior recesses for the horizontal positioning of the centrifuge tubes.

Reference is made to FIG. 3, showing the rotor 10 having its top 12 removed from the rotor base 14. Projecting from the rotor base 14 is a frustroconical portion 16 having a plurality of flutes 18 which are designed to cooperatively react with driving air being impinged upon them to spin the rotor during operation as will be explained. Formed within the rotor base 14 are a plurality of recesses 20 each of which is designed to receive a small 4.8 by 19.9 millimeter centrifuge tube 22 that is oriented in generally a horizontal or perpendicular orientation with respect to the vertical spin axis 24 of the rotor 10. The top 12 is designed to be securely fastened to the rotor base 14 by the use of a threaded bolt 26. The bolt is inserted through the aperture 28 in the top 12 and into the threaded cavity 30 in the rotor base 14.

Figure 1:
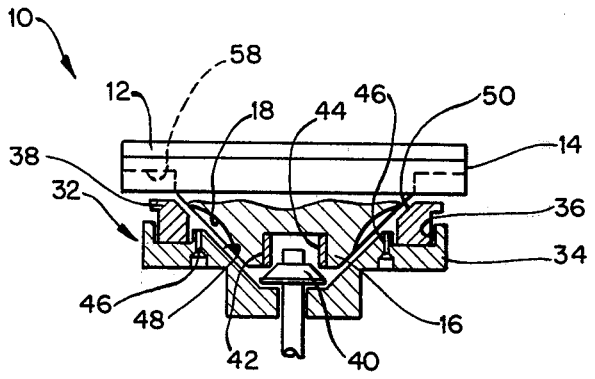
FIG. 1 is a partial sectional view of the air driven centrifuge rotor of the present invention located on the rotor seat portion of the centrifuge machine.

The placement of the rotor 10 on a centrifuge rotor seat 32 is shown more clearly in FIG. 1. The rotor seat 32 includes a stator pad base 34 having an annular channel 36 formed thereon to receive the stator pad 38. Located in the center of the stator pad base 34 is a brake and stabilizing means 40 which operates in conjunction with a bushing 42 in the recessed opening 44 in the rotor 10 to provide stabilization of the rotor at low rotational speeds as well as to provide improved braking system for decelerating the rotor. Reference is made to U.S. Pat. No. 3,958,753 which more clearly describes the operation of the brake and stabilizing feature of an air driven centrifuge.

Also located within the stator pad base 34 are a plurality of air jets 46 designed to direct driving air on the flutes 18 of the rotor 10. This will cause the rotation of the rotor during operation of the centrifuge to provide the desired centrifugally induced forces on the samples within the rotor. It should be noted that the frustoconical interior surface 48 of the stator pad base 34 as well as the frustoconical interior surface 50 of the stator pad 38 are designed to generally mate with the frustoconical portion 16 of the rotor.

Figure 6:
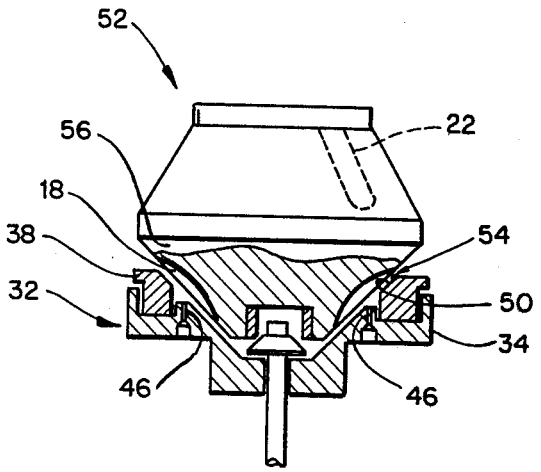
FIG. 6 is a partial sectional view of a prior art rotor located on the rotor seat of an air driven centrifuge.

As shown in FIG. 6, a typical presently used air driven centrifuge rotor 52 is designed to hold the centrifuge tubes in an acute angle orientation with respect to the spin axis of the rotor as shown in phantom lines with respect to one tube 22. When the air exits the air jets 46 and impinges upon the flutes 18 in the rotor 52, it is necessary to provide an adequate air relief path for the exit of this air that is flowing at high volume and speed to provide the necessary driving force for centrifugation. Therefore, the mating of the rotor 52 with the rotor seat 32 in FIG. 6 is such that a direct air relief path 54 is available along the inclined surface 50 of the stator pad 38 and the inclined surface of the frustoconical portion 56 of the rotor. The flow of the air through this direct passage 54 and into the rotor chamber must be unrestricted in order to provide stable and smooth operation of the centrifuge rotor especially at high speeds.

With respect to FIG. 1 the rotor 10 is designed to hold the centrifuge tubes as shown in FIG. 3 in a horizontal orientation during centrifugation. However, in order to provide enough room for the fixed horizontal orientation of the centrifuge tubes 22, it is necessary to enlarge the rotor base 14 of the rotor with respect to the frustoconical portion 16 as shown in FIG. 1. Consequently, a rotor base 14 which contains the horizontally oriented tubes extends over and covers not only the complete stator pad 38, but also the rotor seat 32. Consequently, the interface between the rotor 10 and rotor seat 32 in FIG. 1 does not provide a direct air passage 54 as shown in FIG. 6 between the rotor 10 and the rotor seat 32. The operation of the rotor shown in FIG. 1 results in unstable operation during ultracentrifugation unless some modification is done to the rotor or the rotor seat in order to provide adequate air relief path to accommodate the exiting driven air.

Figure 4:
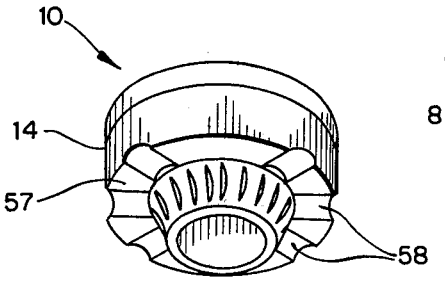
FIG. 4 is a perspective view of the air relief paths in the bottom of the rotor embodiment shown in FIG. 1.

FIG. 4 shows more clearly the rotor 10 of the present invention having in the bottom 57 its rotor base 14 a plurality of grooves or channels 58. The placement of the grooves 58 in the rotor 10 provides an enlarged air relief pathway for the exiting driving air. The plurality of grooves 58 are uniformly positioned in annular and radial orientation along the bottom 57 of the rotor base 14. Consequently, when the rotor 10 is positioned on the rotor seat 32 shown in FIG. 1, the grooves 58 shown in phantom will establish significant enough space between the stator pad 38 and the rotor to allow the requisite amount of driving air to exit from between the rotor and the rotor seat and allow stable operation of the rotor.

Figure 2:
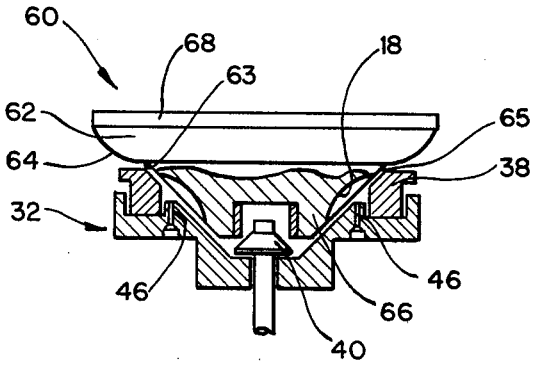
FIG. 2 is an alternate embodiment of the air driven centrifuge rotor of the present invention position on the rotor seat of the centrifuge machine as in FIG. 1.

A preferred embodiment of the present invention is shown in FIG. 2 with the rotor 60 including the rotor base 62 having a rounded beveled portion 64 adjacent the stator pad 38 in order to allow adequate flow of exiting air along the path 65 between the rotor 60 and the rotor seat 32. The beveled rounded portion 64 is on the bottom 63 of the rotor base 62 between the projecting furstoconical portion 66 and the top 68 of the rotor. Adequate spacing between the rotor base 62 and the rotor seat 32 is established by the beveled portion 64, so that the air path 65 is sufficiently large enough to accommodate the flow of air from the drive jets 46. The large diameter rotor 60 can be utilized on the same rotor seat 32 which is designed for the smaller angle tube centrifuge rotor 52 shown in FIG. 6. Consequently, the owner of a centrifuge having an air drive rotor seat 32 will be able to accommodate a large diameter rotor 60 as shown in FIG. 2 with the tubes oriented in a fixed horizontal position. This will give the user a variety in the types of rotors that can be used with his centrifuge machine.

Figure 5:
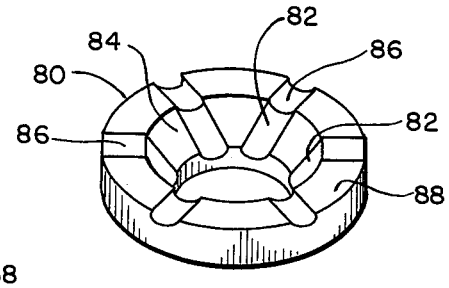
FIG. 5 is a perspective view of the stator pad portion of the rotor seat modified according to an alternate embodiment of the present invention.

A further embodiment of the present invention is shown in FIG. 5 wherein the stator pad 80 is shown having a plurality of grooves or channels 82 along its internal frustoconical surface 84 with continuation grooves or channels 86 along its top flat surface 88. The grooves 82 and 86 are uniformly positioned annularly around the circumference of the stator pad 80 and, therefore, when placed within the rotor seat 34 as shown in FIG. 1 as a replacement of the stator pad 38, the modified stator pad 80 will provide a sufficiently large enough air path to permit the stabilized exit of the driving air during the operation of the centrifuge rotor, allowing the rotor to operate smoothly without wobbling or being unstable. It is envisioned that the stator pad 80 could be used with or without a rotor having the grooves 58 as shown in the rotor 10 of FIG. 4. However, it may be desirable to combine the utilization of the rotor 10 in FIG. 4 with the stator pad 80 in FIG. 5 to create the desired enlarged air path for the exiting of the driving air. This combination may reduce the necessary size or depth of the grooves in both the rotor, as well as the stator pad.

It should be noted with respect to FIG. 3 that the centrifuge tubes 22 are preferably of the 4.8 by 19.9 millimeter size. Because of their extremely small size, it is not necessary to provide a capping means on the top of the centrifuge tubes, since the surface tension between the interior of the tube and the fluid sample is sufficient to prevent the escape of any fluid when the tube is positioned in its horizontal orientation as shown in FIG. 3.

What is claimed is:

1. An air driven centrifuge rotor comprising:

a rotor base having a plurality of recesses for receipt of a plurality of centrifuge tubes;

a frustoconical portion projecting from said rotor base for mating with a centrifuge rotor seat having a stator pad;

means on said frustoconical portion for cooperatively reacting with the drive force of air to spin said rotor, said rotor base being larger than said stator pad and covering said seat; and means integral with one of said rotor and said seat for creating an enlarged air relief path between said rotor and said seat for stabilized operation of said rotor at high speeds.

2. An air driven centrifuge rotor comprising:

a rotor base having a plurality of recesses for receipt of centrifuge tubes, each of said recesses made in such a manner that the longitudinal axis of said centrifuge tubes will assume a fixed position perpendicular to the spin axis of said rotor;

a frustoconical portion projecting from the bottom of said rotor base for mating with a centrifuge rotor seat and having a plurality of flutes for cooperatively operating with driving air in said rotor seat to spin said rotor, said bottom of said rotor base covering said rotor seat; and means on said bottom of said rotor base for creating an air relief path of sufficient size between said rotor and said rotor seat when said rotor is operating so that said rotor will rotate in a stable and smooth manner.

3. An air driven centrifuge rotor as defined in claim 1 or 2 and additionally comprising a top secured to said rotor base to enclose and support said tubes within said recesses.

4. An air driven centrifuge rotor as defined in claim 3, wherein said means for creating an enlarged air relief path comprises a rounded bevel on said bottom of said rotor base between said frustoconical portion of said rotor and said top of said rotor.

5. An air driven centrifuge rotor as defined in claim 1 or 2, wherein said means for creating an enlarged air relief path comprises a plurality of grooves in said bottom of said rotor base between said frustoconical portion and the side of the rotor.

6. An air driven centrifuge rotor as defined in claim 1, wherein said means for creating an enlarged air relief path comprises a plurality of grooves in said stator pad.

7. An air drive centrifuge comprising:

a rotor seat with a plurality of drive air jets;

a stator pad on said rotor seat, said rotor seat and said stator pad forming a frustoconical recess;

a rotor base having a plurality of cavities for receipt of a plurality of centrifuge tubes, said cavities orienting the longitudinal axis of said tube perpendicular with the spin axis of the rotor;

a frustoconical portion projecting from the bottom of said rotor base for receipt within said frustoconical recess of said rotor seat and said stator pad, said frustoconical portion having a plurality of flutes for acting cooperatively with said drive air jets to rotate said rotor during centrifuge operation, said rotor base covering said rotor seat and said stator pad; and means on one of said rotor and said seat cooperatively acting with the other of said rotor and said rotor seat for creating an enlarged air relief path between said bottom of said rotor base and said rotor seat so that air from said drive air jets will exit between said rotor and said rotor seat without affecting the stable operation of said rotor.

* * * * *